United States Patent [19]

Asami et al.

[11] Patent Number: 4,645,429

[45] Date of Patent: Feb. 24, 1987

[54] ROTARY COMPRESSOR

[75] Inventors: Kazutomo Asami; Fumiaki Sano, both of Shizuoka; Koji Ishijima, Fujieda; Fumio Wada; Takuho Hirahara, both of Shizuoka, all of Japan

[73] Assignee: Mitsubishi Denki Kabushiki Kaisha, Tokyo, Japan

[21] Appl. No.: 746,123

[22] Filed: Jun. 18, 1985

[30] Foreign Application Priority Data

Jun. 25, 1984 [JP] Japan ..... 59-130522

[51] Int. Cl.[4] ..... F04C 18/00; F04C 29/02

[52] U.S. Cl. ..... 417/312; 417/366; 417/372; 417/902; 418/94

[58] Field of Search ..... 417/902, 366, 372, 312; 418/94

[56] References Cited

U.S. PATENT DOCUMENTS

| | | | |
|---|---|---|---|
| 3,015,222 | 1/1962 | Wellborn | 417/902 X |
| 3,146,605 | 9/1964 | Rachfel et al. | 417/366 |
| 3,301,232 | 1/1967 | Eickmann | 418/94 X |
| 3,356,293 | 12/1967 | Butts | 417/902 X |
| 4,355,963 | 10/1982 | Tanaka | 417/902 X |
| 4,365,941 | 12/1982 | Tojo et al. | 417/372 |
| 4,472,121 | 9/1984 | Tanaka et al. | 417/902 X |
| 4,552,518 | 11/1985 | Utter | 418/55 |
| 4,561,829 | 12/1985 | Iwata et al. | 418/94 |

*Primary Examiner*—Carlton R. Croyle
*Assistant Examiner*—Theodore Olds
*Attorney, Agent, or Firm*—Oblon, Fisher, Spivak, McClelland & Maier

[57] ABSTRACT

The discharge gas which has been compressed by the compressor main body is cooled by heat dissipation through the heat exchanger, after which it is again returned to the compressor. When the lubricant oil is sucked under pressure of the discharge gas, it is also cooled. Each and every component part of the compressor main body and the electric motor is cooled by causing the cooled discharge gas to pass there through, whereby the temperature rise in the compressor as a whole can be suppressed.

5 Claims, 6 Drawing Figures

ROTARY COMPRESSOR

This invention relates to a rotary compressor. More particularly, it is concerned with a rotary compressor of a type in which a compressor main body is placed in a tightly closed container and lubricant oil to effect lubrication of the compressor main body is reserved in the inner bottom part of the container.

The conventional rotary compressor of this type with the compressor main body being placed within the tightly closed container is so constructed that the compressor main body is driven by an electric motor housed in the tightly closed container in the same manner as mentioned above, and that, with driving of the compressor main body, the lubricant oil reserved in the inner bottom part of the tightly closed container is fed to each and every sliding part of the compressor main body.

In this type of the rotary compressor, however, heat generation occurs from every sliding part accompanied by driving of the compressor main body, and, in some cases, the amount of heat dissipated does not correspond to increase in the amount of heat generated. In particular, there was a disadvantage such that, with a compressor of a large capacity, the amount of heat generated would become large, and that, when the amount of heat generated exceeded the amount of heat dissipated, the temperature of the compressor as a whole rose with the consequence that the performance of the compressor was lowered. In more detail, the disadvantage was such that, when the temperature of the compressor as a whole went up, there took place pre-heating of an intake gas, decrease in the sealing property of the lubricant oil, lowering in the oil firm sustaining force of the lubricant oil, deterioration in every insulating material of the electric motor, and so forth, with the consequent decrease in the operational reliability of the compressor.

The present invention aims at ameliorating the disadvantages inherent in the conventional rotary compressor as described in the foregoing, and providing an improved rotary compressor which has successfully reduced the temperature increase in the compressor as a whole. The characteristic feature of the present invention resides in the fact that a discharge gas as a coolant gas which has been compressed in the compressor main body is supplied to the lubricant oil or the heat generating parts of the compressor main body so as to cool these parts.

According to the present invention, in a general aspect of it, there is provided a rotary compressor of a construction wherein a compressor main body is fitted in a tightly closed container, and a lubricant oil to effect lubrication of the compressor main body is stored in an inner bottom part of said tightly closed container. The rotary compressor is characterized in that it is provided with cooling means for cooling a discharge gas which has been compressed and feeding means for a discharge gas feeding channel formed in a manner to cause the discharge gas which has been cooled by the cooling means to pass through a stator part of an electric motor element of the compressor main body.

According to the present invention, in another aspect of it, there is provided a rotary compressor of a construction wherein a compressor main body is fitted in a tightly closed container, and a lubricant oil to effect lubrication of the compressor main body is stored in an inner bottom part of the tightly closed container. The rotary compressor is characterized in that it is provided with cooling means for cooling a discharge gas which has been compressed. A channel is formed in at least one other part than a crank shaft in a compression element constituting the compressor main body in order that the discharge gas which has returned to the tightly closed container from the cooling means may be caused to pass while it is in direct contact with the inside or the outside of the element. The one other element part is either a main bearing or an end bearing which is disposed at both ends of a cylinder as the compression element and bears thereon the rotational shaft of a piston to perform eccentric rotation within the compression chamber in the cylinder. The channel is constructed with two openings piercing through the bearings and a groove formed in a manner to cause the two openings to be communicatively connected at a closely contacted surface of the bearing with the cylinder.

The foregoing objects, other objects, as well as specific construction and operations of the rotary compressor according to the present invention will become more apparent and understandable from consideration of the following detailed description thereof, especially when taken in conjunction with the accompanying drawings.

In the following, the rotary compessor of the present invention will be explained in specific detail with reference to a few preferred embodiments thereof shown in the accompanying drawing.

Figure 1:
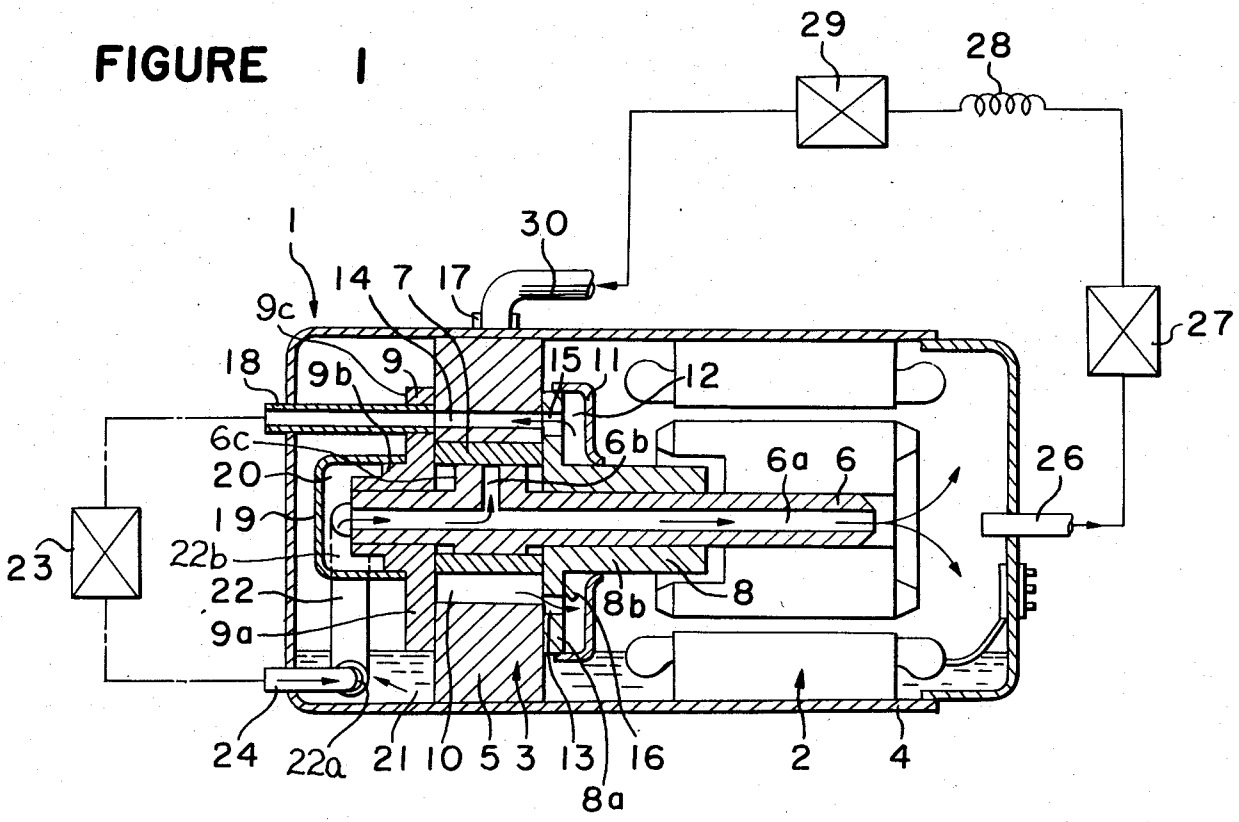
FIG. 1 is a cross-sectional view showing the rotary compressor according to a first embodiment of the present invention.

FIG. 1 illustrates a rotary compressor 1 according to a first embodiment of the present invention.

The rotary compressor 1 includes a tightly closed container 4 housing in its interior an electric motor 2 and a compressor main body 3 to be driven by the motor. The compressor main body 3 is constructed with various compressing elements such as an annular cylinder 5, a piston 7 which rotates eccentrically within the cylinder 5 on a crank shaft 6 having an eccentric support part 6*c* for supporting the piston 7, a main bearing 8 and an end bearing 9 on which are positioned in close contact with both side surfaces of the cylinder 5 and bears thereon the crank shaft 6, and so forth. The main bearing 8 is comprised of a flanged portion 8*a* and a boss 8*b*, and the end bearing 9 is comprised of a flanged portion 9*a* and a boss 9*b*. The flanged portion 9*a* comes into contact with the side surfaces of the cylinger 5 to close the center opening thereof. A compression chamber 10 is defined by the flanged portions 8*a* and 9*a* of the main bearing 8 and the end bearing 9, the cylinder 5, and the piston 7, which rotates eccentrically in its interior. The compression chamber 10 is slidably disposed in an opening (not shown in the drawing) formed in the cylinder 5 in its diametrical direction, and it is divided into a high pressure compartment and a low pressure compartment by a vane (not shown in the drawing). The distal end of the vane is in constant contact with the outer peripheral surface of the piston 7.

A silencing plate 11 is fittingly mounted in hermetic sealing engagement on the outer periphery of the boss 8*b* of the main bearing 8. The outer peripheral end of the silencing plate 11 is fitted in close contact with the outer periphery of the flanged portion 8*a*, thereby forming a silencing chamber 12 defined by the silencing plate 11 outside the flanged portion 8*a*. At the flanged portion 8*a*, there is formed a discharge opening 13 communicatively connected with the high pressure compartment side of the compression chamber 10. The discharge opening 13 is open to the silencing chamber 12. Furthermore, in the flanged portion 8*a* there is formed a second opening 15 communicatively connected with a gas opening 14 formed in the cylinder 5. The second opening 15 is also open to the silencing chamber 12 in the same manner as the discharge opening 13. At the side of the silencing chamber 12 of the discharge port 13, there is provided a discharge valve 16 which becomes open at the time when the discharge gas is let out into the silencing chamber 12. The cylinder 5 has an intake port (not shown) formed therein, which is communicatively connected to the low pressure compartment side of the compression chamber 10. The intake port is communicatively connected with an intake pipe 17 which comes outward of the tightly sealed container 4.

On the other hand, in the flanged portion 9*a* of the end bearing 9, there is formed a fitting hole 9*c* in conformity to the opening of the gas opening 14 of the cylinder 5. Into the fitting hole 9*c* one end of a lead-out pipe 18 is engageably fitted in a manner to be communicatively connected with the gas opening 14. The other end of the lead-out pipe 18 extends outward from the tightly closed container 4. At the boss 9*b* of the end bearing 9, there is mounted in hermetic sealing engagement an oil sump plate 19 in a manner to enclose the end face thereof. At the center part in the axial direction of the crank shaft 6 to be borne by the main bearing 8 and the end bearing 9, there is formed a through hole 6*a* for the lubricant oil and the discharge gas. One end of the through hole 6*a* is directly open to the interior of the tightly closed container 4 at the side of the electric motor 2, while the other end of the through hole 6*a* is open to an oil sump chamber 20 defined by the oil sump plate 19, the boss 9*b*, and the end of the crank shaft 6, which terminates at the end of the bearing 9. The through hole 6*a* which goes through the center part of the crank shaft 6 is also communicatively connected with a branched hole 6*b* which reaches the outer peripheral surface of the eccentric support part 6*c*.

At the inner bottom part of the tightly closed container 4, there is reserved lubricant oil 21 at a certain definite level. Further, in the tightly closed container 4, there is disposed an oil feeding pipe 22 connected with the oil sump plate 19. One open end 22*a* of the oil feeding pipe 22 is immersed in the lubricant oil 21, and the other open end 22*b* of the oil feeding pipe 22 is connected to the oil sump plate 19 so as to be open into the oil sump chamber 20.

Figure 2:
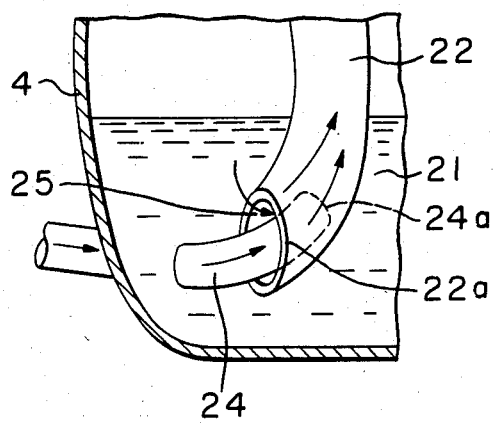
FIG. 2 is a cross-sectional view showing the main part of the compressor in FIG. 1 with one portion having been cut away.

The other end of the lead-out pipe 18 is communicatively connected with a heat exchanger 23 as a cooling means for cooling the compressed discharge gas. One end of an ejection pipe 24 as a feeding means for introducing the cooled discharge gas into the lubricant oil 21 is connected to the outlet side of the heat exchanger 23. The other end 24*a* of the ejection pipe 24, as clearly shown in FIG. 2, is fitted by insertion into the open end 22*a* of the oil feeding pipe 22 which has been immersed in the lubricant oil 21. An arbitrary clearance 25 is formed between the outer peripheral surface of the ejection pipe 24 and the inner peripheral surface of the oil feeding pipe 22. In this manner, the discharge gas which has been sent out of the heat exchanger 23 through the ejection pipe 24 is jetted into the oil feeding pipe 22 from the other end 24*a* of the ejection pipe 24. At the same time, the lubricant oil 21 is drawn through the arbitrary clearance 25 and fed into the oil sump chamber 20 through the oil feeding pipe 22 and then into the through hole 6*a* and the branched hole 6*b* in the crank shaft 6. From this fact, it can be said that both the ejection pipe 24 and the oil feeding pipe 22 construct an oil pump.

On the end face at the side of the electric motor in the tightly closed container 4, there is provided a discharge pipe 26. One end of the discharge pipe 26 is open to the interior of the tightly closed container 4 and the other end thereof is connected with a condenser 27. The condenser 27 is communicatively connected with an evaporator 29 through a capillary tube 28. An outlet side of the evaporator 29 is connected to the intake pipe 17 through an inlet pipe 30.

In the following, explanations will be given as to the operations of the rotary compressor 1 in the embodiment which has been constructed as mentioned above.

As soon as the electric motor 2 commences its operation, the crank shaft 6 is driven to rotate, and the piston 7 which has been fitted on the eccentric support part 6*c* of the crank shaft 6 is subjected to eccentric rotation within the cylinder 5. By this eccentric rotation of the piston 7, the coolant gas which has been sucked into the low pressure side of the compression chamber 10 through the inlet pipe 30 is compressed and transferred to the high pressure side where it causes the discharge valve 16 to open and is let out into the silencing chamber 12. By thus driving the compressor main body 3, suction and discharge of the coolant gas to be compressed are repeated.

The coolant gas which has been discharged into the silencing chamber 12, i.e., the discharge gas, is sent into the heat-exchanger 23 through the second opening 15, the gas opening 14, and the lead-out pipe 18, and subjected to cooling in the heat exchanger 23. The discharge gas which has been cooled through heat dissipation in and by the heat-exchanger 23 is fed into the oil feeding pipe 22 by way of the ejection pipe 24, at which time the lubricant oil 21 is taken into the oil feeding pipe 22 through the arbitrary clearance 25 formed at the overlapping portion of the ejection pipe 24 and the oil feeding pipe 22, by the ejection force of the discharge gas from the ejection pipe 24 as mentioned in the foregoing. Both discharge gas sent into the oil feeding pipe 22 and lubricant oil 21 simultaneously taken in by the ejection force of the discharge gas pass through the through hole 6*a* and the branched hole 6*b* in the crank shaft 6 via the oil sump chamber 20. The discharge gas and the lubricant oil 21 come out into the tightly closed container 4 from the end part of the crank shaft 6 at the side of the electric motor 2. Thus, the lubricant oil 21 is fed to each and every sliding part of the compressor main body 3, and the cooling of the lubricant oil 21 and the compressor main body 3 is done at the same time by the discharge gas, whereby the temperature rise in the compressor as a whole is suppressed.

The lubricant oil 21 and the discharge gas which have come out into the tightly closed container 4 from the end part of the crank shaft 6 move in the following manner: that is to say, the lubricant oil 21, on the one hand, drops into the inner bottom part of the tightly closed container 4 due to its own dead weight to be stored there again; and the discharge gas, on the other hand, passes through the condenser 27 and the capillary tube 28 via the discharge pipe 26, then it is evaporated in the evaporator 29 to carry out its predetermined action, and then it is again sucked into the compression chamber 10 by way of the inlet pipe 30.

By thus feeding the discharge gas into the lubricant oil 21 after it has been cooled, the lubricant oil 21 and the compressor main body 3 are cooled to restrain the temperature rise in the compressor as a whole. Accordingly, it becomes possible to achieve suppression of the preheating of the intake gas, improvement in the sealing property of the lubricant oil 21, prevention of decrease in the operating efficiency of the electric motor 2, suppression of lowering in the oil film the sustaining force of the lubricant oil 21, suppression of deterioration in the individual insulating material of the electric motor 2, and so forth.

Figure 3:
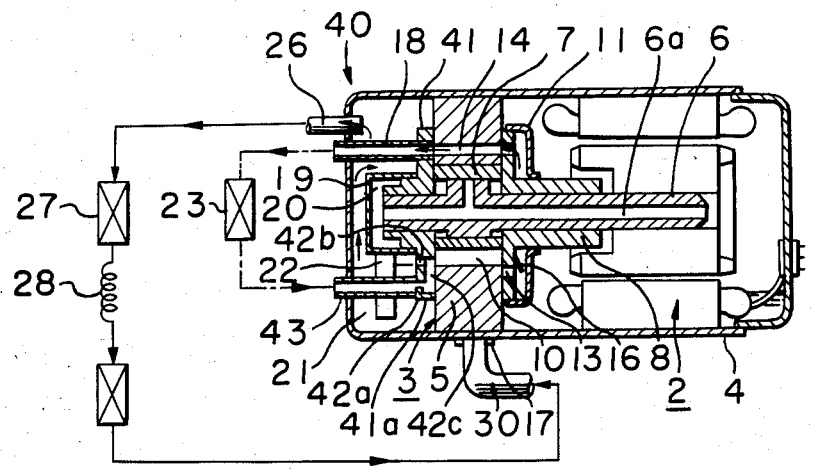
FIG. 3 is a cross-sectional view showing the rotary compressor according to a second embodiment of the present invention.

FIG. 3 illustrates a rotary compressor 40 according to a second embodiment of the present invention. In FIG. 3, those parts which are identical with, or equivalent to, those in the first embodiment shown in FIG. 1 are designated by the same reference numerals, and the explanations for them are dispensed with.

Figure 4:
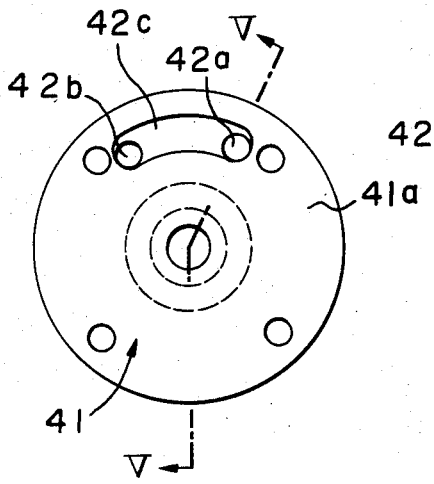
FIG. 4 is a front view showing the end bearing of the compressor shown in FIG. 3.
Figure 5:
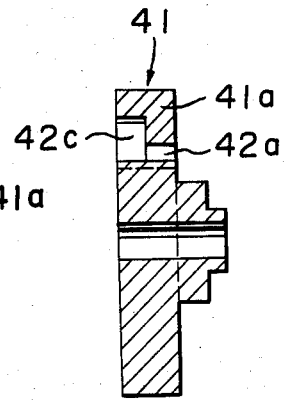
FIG. 5 is a longitudinal cross-sectional view taken along a line V—V in FIG. 4.

The rotary compressor 40 of the second embodiment has two channels 42*a* and 42*b* formed in an end bearing 41 having a flanged portion 41*a* constituting the compressor main body 3. Each of the channels 42*a* and 42*b* transverses the flanged portion 41*a*. Further, in the surface of the flanged portion 41*a* which is in close contact with the cylinder 5 (hereinafter called the "sheet surface"), there is formed a groove 42*c*, as shown in FIGS. 4 and 5, for communicatively connecting the two channels 42*a* and 42*b*. One of these two channels 42*a* and 42*b*, e.g., the channel 42*a* in this embodiment, is connected with one end part of a feeding pipe 42 having its other end joined with the outlet side of the heat exchanger 23. The other channel 42*b* is directly open to the interior of the tightly closed container 4. Further, the discharge pipe 26 is connected with the space within the tightly closed container 4 at the side where the end bearing 41 is present, and is communicatively connected with the inlet pipe 30 through the condenser 27, the capillary tube 28, and the evaporator 29, as is the case with the first embodiment.

According to the second embodiment, the discharge gas which has been cooled in and by the heat-exchanger 23 through heat dissipation passes through the feeding pipe 43 and is sent into the channel 42*a* in the flanged portion 41*a* of the end bearing 41. The groove 42*c* formed in the sheet surface of the flanged portion 41*a* is closed at its sheet surface side by the cylinder 5, on account of which the groove 42*c* has the function of a passageway. As the consequence of this, the discharge gas is sent out into the space within the tightly closed container 4 by way of the groove 42*c* and the other channel 42*b*. At that time, since the discharge gas comes into direct contact with the end bearing 41 and the cylinder 5 of the compression element which constitutes the compressor main body 3, it serves to cool these parts, thereby suppressing the temperature rise in the compressor as a whole.

The discharge gas which hase been returned to the tightly closed container 4 is again introduced into the compression chamber 10 from the discharge pipe 26 through the inlet pipe 30 via the condenser 27, the capillary tube 28, and the evaporator 29.

Since the discharge gas which has been cooled in and by the heat-exchanger 23 through heat dissipation is brought into direct contact with these component parts of the compression element, the cooling effect of the compressor main body 3 further improves, whereby enhanced results can be obtained in suppressing the preheating of the intake gas, improvement in the sealing property of the lubricant oil, and so on.

Figure 6:
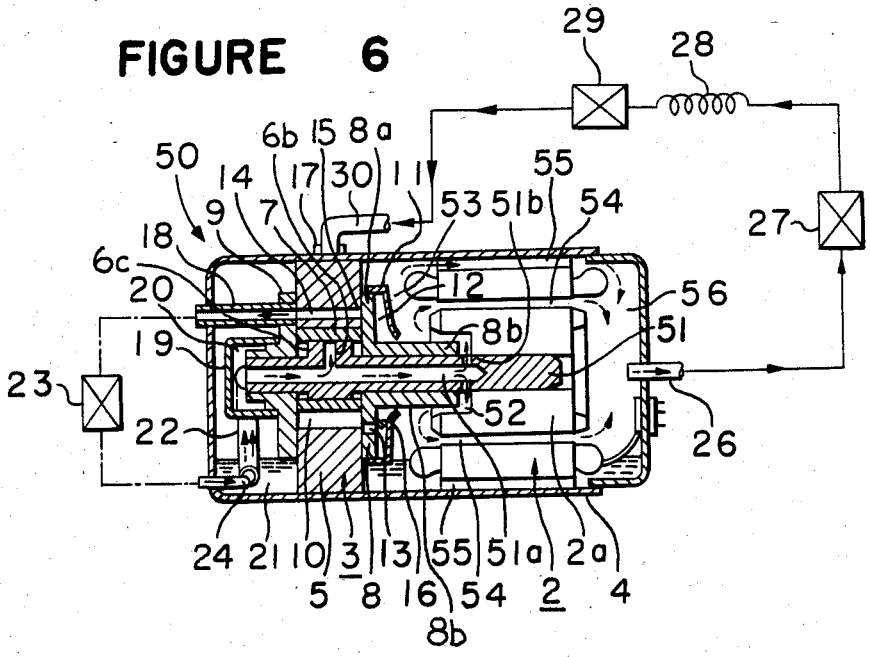
FIG. 6 is a longitudinal cross-sectional view showing the rotary compressor according to a third embodiment of the present invention.

FIG. 6 shows a rotary compressor 50 according to a third embodiment of the present invention. In FIG. 6, those parts which are identical with, or equivalent to, those of the first embodiment shown in FIG. 1 are designated by the same reference numerals, and the explanations therefor are dispensed with.

In the rotary compressor 50 of the third embodiment, the center opening 51*a* of the crank shaft 51, which is the component part for the compression element constituting the compressor as a whole, does not reach the end face at the side of the electric motor, unlike the first embodiment, but is closed in the vicinity of the interior of the electric motor 2. That is to say, the center opening 51*a* is not pierced through in the axial direction of the crank shaft 51. This crank shaft 51, however, has an opening 51*b* which is communicatively connected with the center opening 51*a*, and formed in its diametrical direction. In other words, the center opening 51*a* of the crank shaft 51 is communicatively connected with a space 53 in the tightly closed container 4 between the electric motor 2 and the compressor main body 3 by way of the opening 51*b* and an opening 52. In the drawing of this third embodiment, a reference numeral 54 designates a space gap formed between the stator 2*b* and the rotor 2*a* of the electric motor 2, and a numeral 55 refers to a space formed by extending the stator 2*b* in the vicinity of its outer periphery along the axial direction thereof.

Thus, according to the third embodiment of the construction as described above, the discharge gas and the lubricant oil which have been fed into the oil sump chamber 20, in the same manner as in the first embodiment, pass through the center opening 51*a* of the crank shaft 51 and then come out through the opening 51*b* and between the rotor 2*a* of the electric motor 2 and the main bearing 8, after which they reach the space 53 in the tightly closed container 4. In this space, the lubricant oil drops into the inner bottom part of the tightly closed container 4 to be stored therein. At the same time, the discharge gas is forwarded to a space 56 in the tightly closed container at the right side thereof, as viewed in FIG. 6, with the space gap 54 between the rotor 2*a* and the stator 2*b*, or with the space 55 formed in the stator 2*b*, as the passageway thereof. After this, it is sent out of the space 56 into the condenser 27, the capillary tube 28, and the evaporator 29 through the discharge pipe 26. For the remainder, the compressor functions in the same manner as the first embodiment.

On account of this, the coolant gas which has been cooled and returned to the compressor passes through each and every part of the electric motor 2 and the compressor main body 3 as well. As the consequence of this, the coolant gas deprives the compressor main body 3 and the stator winding of the electric motor 2, and so forth, of heat to thereby cause decrease in their temperature. This results in improvement in the temperature distribution in the compressor as a whole, whereby not only improvement in the performance such as suppression of preheating of the intake gas and improvement in the sealing property of the lubricant oil can be realized, but also service life of the wire and the insulating paper surrounding the wire can be made very long due to lowering of the temperature in the motor winding. Hence high operating reliability of the apparatus is achieved.

As has been explained in the foregoing, according to the rotary compressor of the present invention, the discharge gas which has been compressed by the compressor main body is cooled by heat dissipation through the heat exchanger, after which it is again returned to the compressor. The lubricant oil is also cooled by its being pumped up, and each and every component part of the compressor main body and the electric motor is cooled by causing the lubricant oil to pass there through. In this way, there are attained various advantages such that the temperature rise in the compressor as a whole can be suppressed, the preheating of the intake gas can be restrained, the sealing property of the lubricant oil can be improved, and, at the same time, the decrease in the operating efficiency of the electric motor, the deterioration in each and every insulating material, the decrease in the oil film sustaining force of the lubricant oil, and so forth can be suppressed. As the consequence of these, there can be exhibited remarkable effects such that the performance and operating reliability of the rotary compressor is improved.

Although the present invention has been described in the foregoing with reference to particular embodiments thereof, it will be understood by those skilled in the art that the invention is capable of a variety of alternative embodiments within the spirit and scope of it as set forth in the appended claims.

We claim:

1. A rotary compressor comprising:

(a) a housing comprising a cylindrical body, a first end plate, and a second end plate;

(b) an electric motor disposed in said housing, said electric motor comprising:

(i) a stator coaxially disposed within said cylindrical body of said housing and separated therefrom by a first annular space and (ii) a rotor coaxially disposed within said stator and separated therefrom by a second annular space;

(c) said cylindrical body of said housing, said first end plate of said housing, and said electric motor defining a first end chamber;

(d) a crank shaft coaxially disposed within a cylindrical bore within said rotor and projecting axially therefrom, said crank shaft comprising:

(i) a cylindrical body having a first end inside said rotor and a second end outside said rotor;

(ii) an eccentric support surrounding said cylindrical body;

(iii) an axial blind bore leading from said second end to a point within said rotor;

(iv) at least one radial bore leading from said axial blind bore to the outer surface of said eccentric support part; and (v) a plurality of radial bores leading from said axial blind bore to the outer surface of said cylindrical bore within said rotor;

(e) a piston surrounding said cylindrical body and said eccentric support part of said crank shaft;

(f) an annular cylinder surrounding said piston, said annular cylinder being mounted in said cylindrical body of said housing;

(g) a main bearing surrounding and journalling said cylindrical body of said crank shaft between said rotor and said eccentric support part of said crank shaft, said main bearing comprising:

(i) a boss that extends into said rotor but that does not block said plurality of radial bores in said crank shaft and (ii) a flange that makes sealing contact with said annular cylinder and sliding contact with said piston;

(h) a silencing plate extending from said flange of said main bearing to said boss of said crank shaft;

(i) said silencing plate, said boss of said main bearing, and said flange of said main bearing defining a silencing chamber;

(j) said silencing plate, said electric motor, said boss of said main bearing, and said cylindrical body of said housing defining a central chamber;

(k) an end bearing surrounding and journalling said cylindrical body of said crank shaft between said eccentric support part of said crank shaft and said second end of said crank shaft, said end bearing comprising:

(i) a boss that extends to said second end of said crank shaft and (ii) a flange that makes sealing contact with said annular cylinder and sliding contact with said piston;

(l) said piston, said annular cylinder, said main bearing, and said end bearing defining a compression chamber;

(m) an oil sump plate making sealing engagement with said flange of said end bearing and surrounding said boss of said end bearing and said second end of said cylindrical body of said crank shaft;

(n) said oil sump plate, said flange of said end bearing, said boss of said end bearing, and said cylindrical part of said crank shaft defining an oil sump chamber;

(o) said second end plate of said housing, said cylindrical body of said housing, said oil sump plate, said flange of said end bearing, and said annular cylinder defining a second end chamber;

(p) a condenser, a capillary tube, and an evaporator in fluidic series externally of said housing;

(q) a heat exchanger positioned externally of said housing;

(r) a first path of fluid communication leading from said first end chamber through said condenser, said capillary tube, and said evaporator to said compression chamber;

(s) a second path of fluid communication leading from said compression chamber through said flange of said main bearing to said silencing chamber;

(t) a third path of fluid communication leading from said silencing chamber through said flange of said main bearing, said annular cylinder, said flange of said end bearing, and said second end chamber to said heat exchanger;

(u) a fourth path of fluid communication leading from said heat exchanger to said second end chamber, said fourth path of fluid communication terminating in an outlet located at a level that, during use of the rotary compressor, is beneath the surface of lubricant in said second end chamber;

(v) a fifth path of fluid communication beginning with an inlet that surrounds and is spaced from said outlet of said fourth path of fluid communication, whereby, during use of the rotary compressor, lubricant in said second end chamber enters said inlet of said fifth path of fluid communication and is entrained in compressed gas entering said fifth path of fluid communication from said fourth path of fluid communication, said fifth path of fluid communication leading from said second end chamber to said oil sump chamber;

(w) a sixth path of fluid communication leading from said oil sump chamber through said axial blind bore in said crank shaft and said at least one radial bore to lubricate the interface between said eccentric support plate and said piston;

(x) a seventh path of fluid communication leading from said oil sump chamber through said axial blind bore in said crank shaft, said plurality of radial bores, and between said rotor and said boss of said main bearing into said central chamber;

(y) an eighth path of fluid communication leading from said central chamber through said second annular space to said first end chamber; and (z) a ninth path of fluid communication leading from said central chamber through said first annular space to said first end chamber.

2. A rotary compressor as recited in claim 1 wherein said first path of fluid communication leads through said first end plate.

3. A rotary compressor as recited in claim 1 and further comprising a discharge valve located in said second path of fluid communication.

4. A rotary compressor as recited in claim 1 wherein said third path of fluid communication leads through said second end plate.

5. A rotary compressor as recited in claim 1 wherein said fourth path of fluid communication leads through said second end plate.

* * * * *